US006129472A

United States Patent [19]

Thayer

[11] Patent Number: 6,129,472

[45] Date of Patent: Oct. 10, 2000

[54] MECHANICAL TWIST-DISPENSER

[75] Inventor: Jonathan Thayer, N. Bergen, N.J.

[73] Assignee: Color Access, Inc., Melville, N.Y.

[21] Appl. No.: 09/314,726

[22] Filed: May 18, 1999

[51] Int. Cl.[7] ..... B43K 5/06

[52] U.S. Cl. ..... 401/175; 222/137; 222/390

[58] Field of Search ..... 222/137, 390, 222/23; 401/175

[56] References Cited

U.S. PATENT DOCUMENTS

| | | | |
|---|---|---|---|
| 4,595,124 | 6/1986 | Duval et al. . | |
| 5,104,005 | 4/1992 | Schneider, Jr. et al. | 222/137 |
| 5,437,513 | 8/1995 | Favre . | |
| 5,529,416 | 6/1996 | Favre . | |
| 5,566,860 | 10/1996 | Schlitz et al. | 222/137 |

FOREIGN PATENT DOCUMENTS

| | | |
|---|---|---|
| 124 852 | 11/1984 | European Pat. Off. . |
| 2651485 | 3/1991 | France . |
| 2721907 | 1/1996 | France . |
| WO 93/17936 | 9/1993 | WIPO . |

*Primary Examiner*—Philippe Derakshani
*Attorney, Agent, or Firm*—Kenyon & Kenyon

[57] ABSTRACT

A mechanical twist-dispenser having a plurality of product compartments within a housing, a rotatable screw member axially disposed within each product compartment, and a piston axially slidably disposed within each product compartment. The piston has a central threaded aperture which cooperates with the screw member to move the piston axially within its product compartment with the relative rotation of its associated screw member. A master gear is positioned between and contacts each screw member gear such that the rotation of the master gear causes the screw member to rotate and subsequently move the piston axially within the product compartment so as to dispense the product within each compartment.

37 Claims, 8 Drawing Sheets

MECHANICAL TWIST-DISPENSER

FIELD OF THE INVENTION

The present invention relates to mechanical twist dispensers. More particularly, it relates to mechanical twist dispensers which house two or more products separately and dispense those separated products simultaneously.

BACKGROUND OF THE INVENTION

Certain cosmetic, pharmaceutical, household, industrial, and food related products are formulated with multiple phases which need to be kept separate until ready for use. The ability of the package to keep the multiple phases separate until ready for use, as well as provide the consumer with an easy to use device has heretofore been a major obstacle.

Previous attempts to package such multiple phase products included packaging each phase of the product in separate containers which need to be opened separately and mixed within a third container before use by the consumer. The problem with the use of this style package is that a container for each phase, as well as a mixing container, has to be packaged in a single shipping container for sale to the consumer. This increased number of components required for packaging the product for sale increases the cost of the product as well as the cost to ship the product to its intended destination.

Other systems have been proposed which utilize a separate pump for each phase of the product, wherein each of these pumps is bound by a common actuator. Aside from the complexity of the pump structure and the increased costs associated with using this type of complicated dispensing system, there still remain significant drawbacks to this system. First, as is common with multiple phase products, each phase of the product typically does not have the same physical properties as the other phases. When these phases are placed in a multiple pump system the different physical characteristics associated with each phase can cause inaccuracies in the priming of each individual pump, the dose expelled by those pumps, and the resultant uneven use-up of each phase of the product thereby typically leaving one phase remaining in its respective container while the other phase is spent. These problems become especially prevalent when the multiple phase product requires exacting metered doses of each phase to be mixed together in order to obtain the optimum properties of the product.

French Patent 2,721,907, describes a dosing mechanism for dispensing two products at the same time. This structure comprises a box having two distinct containers, and a double piston extending across the two containers. The double piston has a control mechanism attached to it. The control consists of a screw threaded shaft attached to the top of the container, and a nut which runs on the shaft. The nut is attached to the double piston so that rotation of the shaft advances the nut and moves the pistons within their respective containers. The drawback to this dispenser is that the overall height of the container has to be at least double the height of the individual containers in order to dispense substantially all of the product contained therein. This is because each container must have an uninterrupted wall in order to keep the two products contained therein separate. With this uninterrupted wall, the double piston must have an upside-down U shaped member which connects the piston within each container to the shaft. This U shaped member must be at least as long as each container. If the U shaped member were not at least as long as each container, then either the entire contents of the container would not be dispensed, or each container wall would have to be provided with a slot within which the piston could travel so that the piston could reach the bottom of the container. Either of these configurations is not practical because one is forced either to design a package which is relatively lengthy or one which does not dispense all of the product within each container.

French Patent 2,651,485, discloses a container/dispenser for two different products of a similar consistency. The container consists of a housing with two separate chambers for the two products, and a mechanism for expelling them through two separate outlets at the top which is operated by an actuator with access from the outside of the container. The mechanism for expelling the products is in the form of pistons inside the two chambers, operated by a telescoping screw mechanism and a knurled wheel the knurled wheel engages with cogs on the ends of the piston screws to drive the pistons within the two chambers. Similar to French Patent 2,721,907, this dispenser has to have an increased height so that the telescoping screw member can be fully contained within the dispenser.

Additionally, many if not most of the multiple phase dispensing systems, such as those described above, require the consumer to mix each phase of the product together after dispensing. Typically, in the case of topically applied pharmaceutical or cosmetic products, the consumer must dispense each phase of the product onto the intended area of the body. Then, the consumer must mix the multiple phases together in order for the product to perform its intended function. The problem with having a consumer mix a multiple phase product directly on the skin is that, before the phases are mixed together, the consumer may have an adverse reaction to any one of the phases in its unmixed form.

SUMMARY OF THE INVENTION

The present invention is a mechanical twist-dispenser which comprises a housing which has a top end, a bottom end, and a plurality of first walls extending longitudinally from the bottom end to the top end of the housing, each first wall defining a separate product compartment for each component of the product. Each product compartment has a first open end and a second open end.

A rotatable screw member is axially disposed within each product compartment. Each screw member has a proximal end and a distal end. A gear is attached to the distal end of each screw member, said gear rotatably disposed at the second open end of each product compartment.

A piston is axially slidably disposed within each product compartment. The piston has a central threaded aperture which cooperates with the screw member to move the piston axially within its product compartment with the relative rotation of the associated screw member.

A master gear is rotatably mounted to the bottom of the housing. The master gear contacts each screw member gear such that the rotation of the master gear causes each screw member gear to rotate, which, in turn, causes the piston to slide axially within the product compartment through the interaction between the threaded aperture of the piston and the screw member.

The resultant movement of the piston causes the product within the product compartment to be dispensed through an end cap which is fitted over the top end of the housing. The end cap is provided with a plurality of longitudinally extending second walls. The second walls extend through the end cap from a first open end to a second open end and align with the first open end of the product compartment to form a dispensing passageway when the end cap is placed on the top end of the housing.

In a preferred embodiment, the end cap is provided with a mixing surface. The mixing surface is obtained by providing the end cap with a flat or concave face which intersects with the second open end of each second wall. The mixing surface provides the consumer with an area on the package for mixing together the products within each product compartment before application.

BRIEF DESCRIPTION OF THE DRAWINGS

Further objects, features and drawings of the present invention will better be understood in light of the embodiment examples which are discussed below with the aid of a drawing wherein.

DETAILED DESCRIPTION OF THE INVENTION

Figure 1:
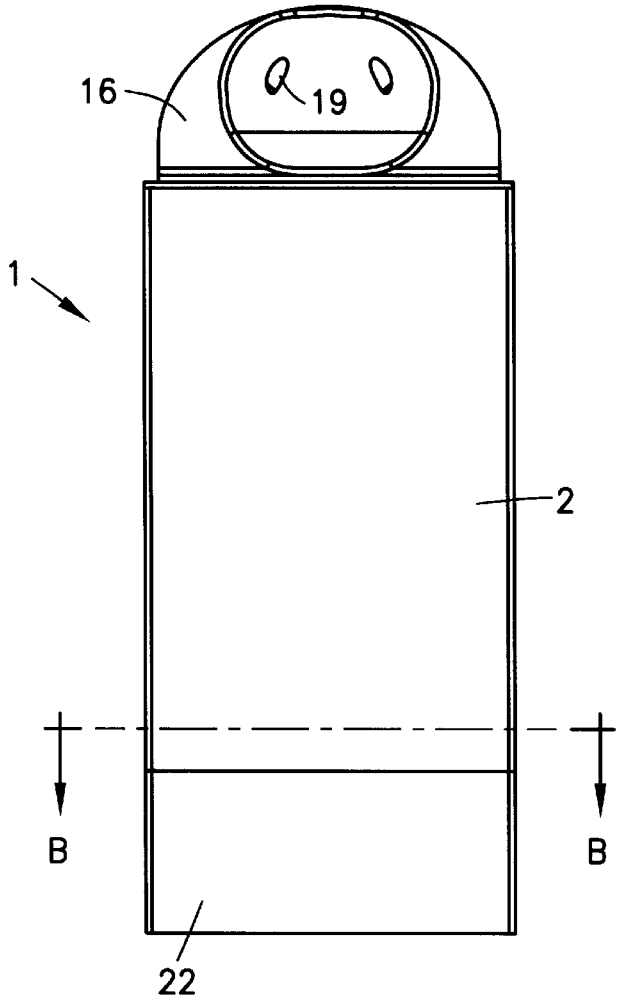
FIG. 1 is a front plan view of one embodiment of the twist-dispenser of the present invention.
Figure 3:
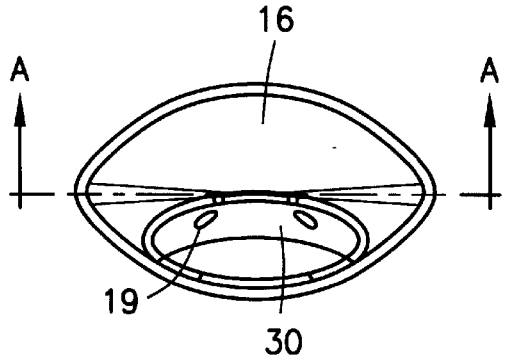
FIG. 3 is a top plan view of the twist-dispenser of FIG. 1.
Figure 2:
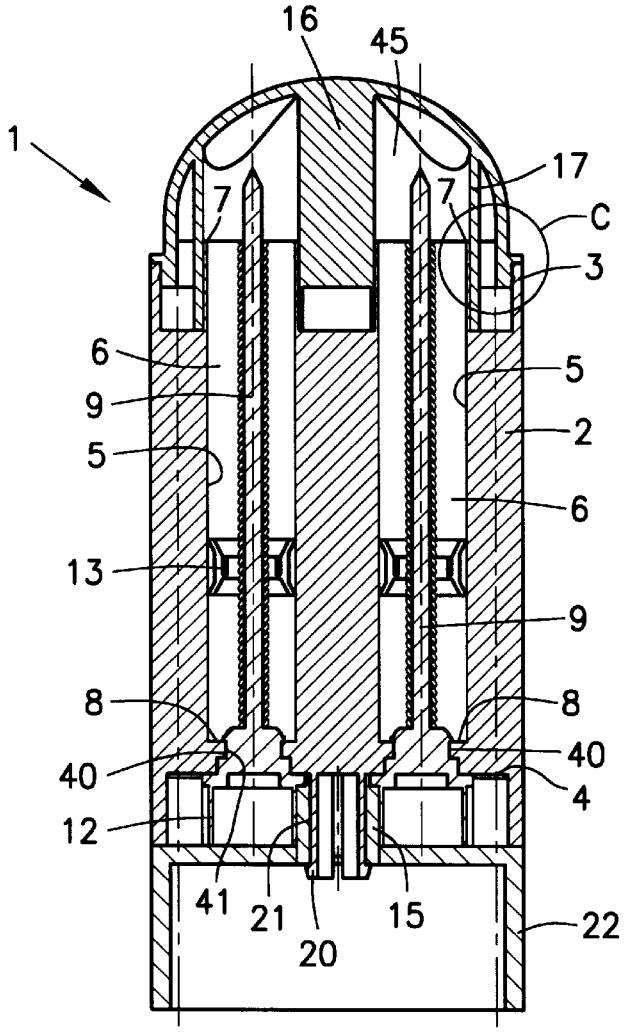
FIG. 2 is a cross-sectional view of the twist-dispenser along line A—A of FIG. 3.

Referring now to the drawings, FIG. 1 shows one embodiment, generally referred to as 1, of the mechanical twist-dispenser of the present invention. The twist-dispenser comprises a housing 2 having a top end 3 and a bottom end 4. As seen more clearly in FIG. 2, the housing 2 is provided with a plurality of walls 5 which extend longitudinally from the bottom end 4 to the top end 3 of the housing 2. Even though FIGS. 1 and 2 show only two walls, it will be evident from the present disclosure that any number of walls can be provided within the housing of the present invention. Each wall 5 defines a separate product compartment 6, each of which has a first open end 7 and a second open end 8.

Figure 5:
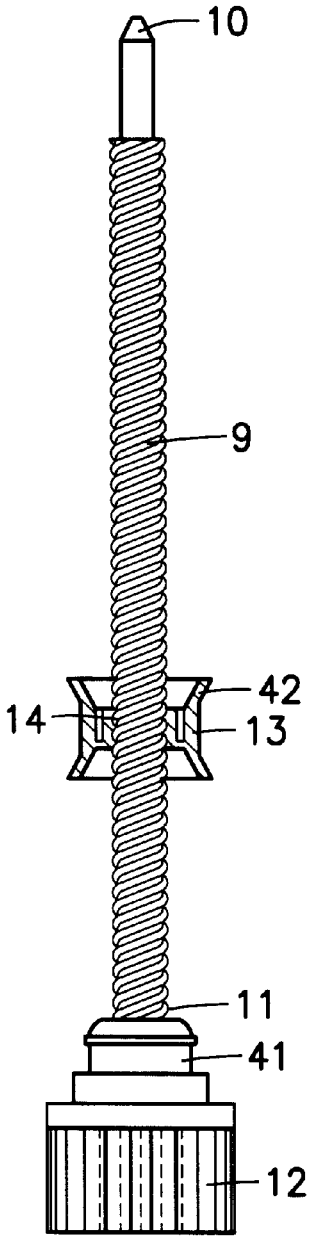
FIG. 5 shows the screw member and piston of the present invention.

A rotatable screw member 9 is axially disposed within each product compartment 6. As seen in greater detail in FIG. 5, each screw member 9 has a proximal end 10 and a distal end 11 and is threaded along its axis. A gear 12 is attached to the distal end 11 of each screw member 9. Each gear 12 is rotatably disposed at the second open end 8 of each product compartment 6. Preferably, the screw member 9 is rotatably held at the second open end 8 of each product compartment 6 by providing the open end 8 with an inwardly projecting rim 40 which fits within a recess 41 at the distal end 11 of the screw member 9.

A piston 13 is axially slidably disposed within each product compartment 6. Each piston 13 has a central threaded aperture 14 which cooperates with the screw member 9 to move the piston 13 axially within the product compartment 6 with the relative rotation of the gear 12. The perimeter 42 of the piston 13 is designed to contact the wall 5 of the product compartment 6 in such a manner which will allow the piston 13 to move axially within the product compartment 6. It will be evident to the skilled artisan that the degree of contact required between the perimeter of the piston and the wall of the product compartment will depend on the characteristics of the product contained within each product compartment. For example, if the product is relatively non-viscous then the degree of contact will have to be greater in order to form a barrier through which the product will have difficulty passing.

A master gear 15 is rotatably mounted to the bottom 4 of the housing 2. As seen in greater detail in FIGS. 4 and 11–14, the master gear 15 contacts each screw member gear 12. The rotation of the master gear 14 causes each screw member gear 12 to rotate, which, in turn, causes the piston 13 to slide axially within the product compartment 6 through the interaction between the threaded aperture 14 of the piston and the screw member 9.

Figure 4:
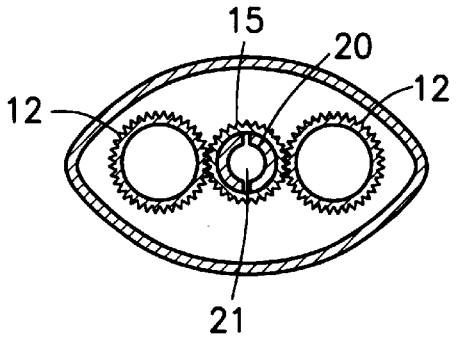
FIG. 4 is a cross-sectional view of the twist-dispenser along line B—B of FIG. 1.

In a preferred embodiment, as seen in FIG. 4, the master gear 15 is positioned between and contacts each screw member gear 12. With this embodiment, the master gear 15 is preferably provided with a longitudinal bore 21 therethrough that fits about a boss 20 which depends from the bottom end 4 of the housing 2. In the alternative, the master gear 15 can be provided with a boss which extends from upper surface of the master gear while the bottom of the housing is provided with an aperture within which the boss fits so as to allow the master gear to rotate. In order to enable the consumer to easily rotate the master gear 15, a base 22 is preferably attached thereto. The base 22 affords the consumer and area that is easily gripped, thereby allowing easier rotation of the master gear 15.

Figure 11:
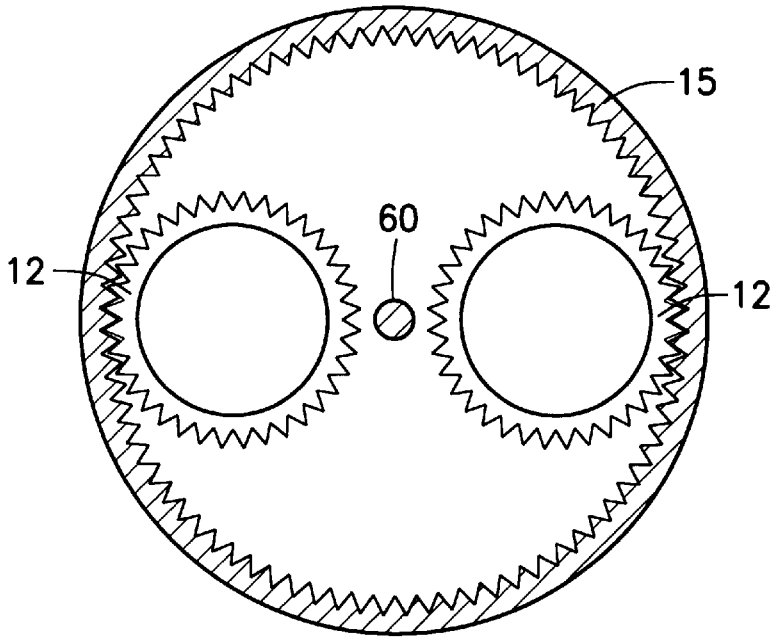
FIG. 11 is a cross-sectional view of a further embodiment of the twist-dispenser of the present invention along line F—F of FIG. 12.
Figure 12:
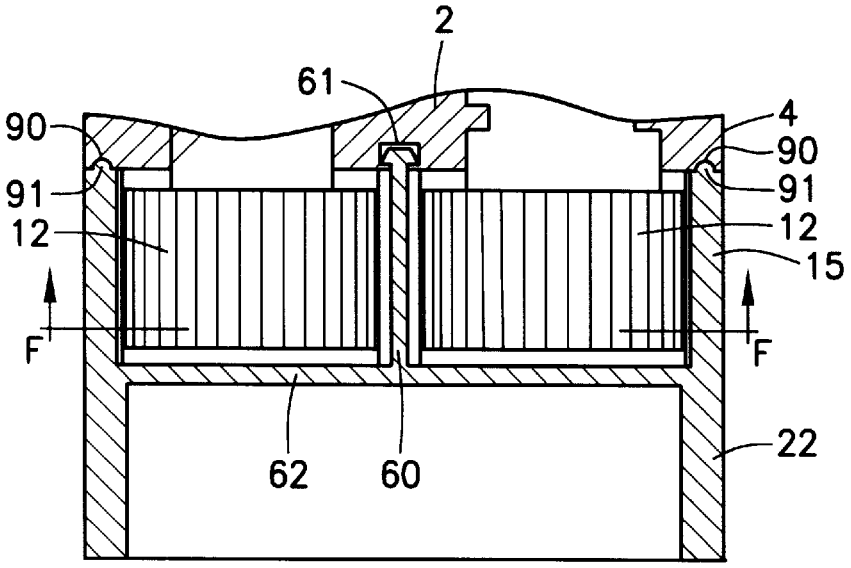
FIG. 12 is a partial cross-sectional view showing the screw members and master gear according to the embodiment of FIG. 11.

In an alternative embodiment, as seen in FIG. 11, the master gear 15 can be formed so as to wrap around and contact each screw member gear 12. With this embodiment, the master gear 15 is rotatably attached to the bottom of the housing by a post 60 which engages a recess 61 in the bottom of the housing, as seen in FIG. 12. With this embodiment, the master gear 15 and the base 22 are preferably formed as an integral unit, thereby allowing the post 60 to extend from a dividing wall 62 positioned between the base 22 and the master gear 15.

Figure 13:
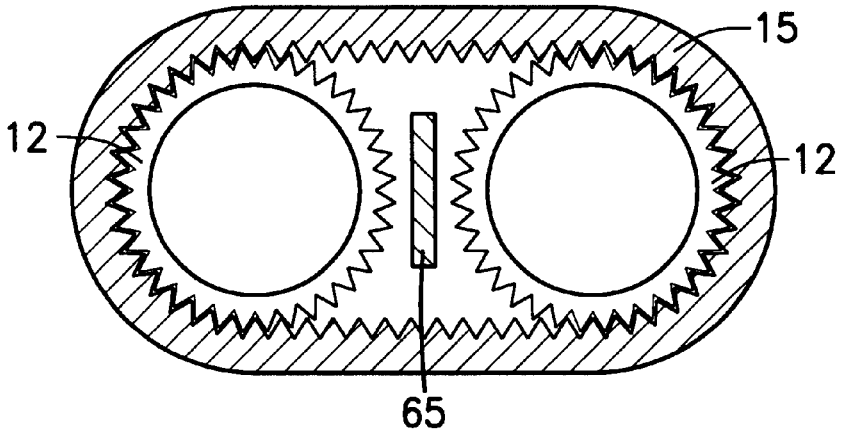
FIG. 13 is a cross-sectional view of another embodiment of the twist-dispenser of the present invention along line G—G of FIG. 14.
Figure 14:
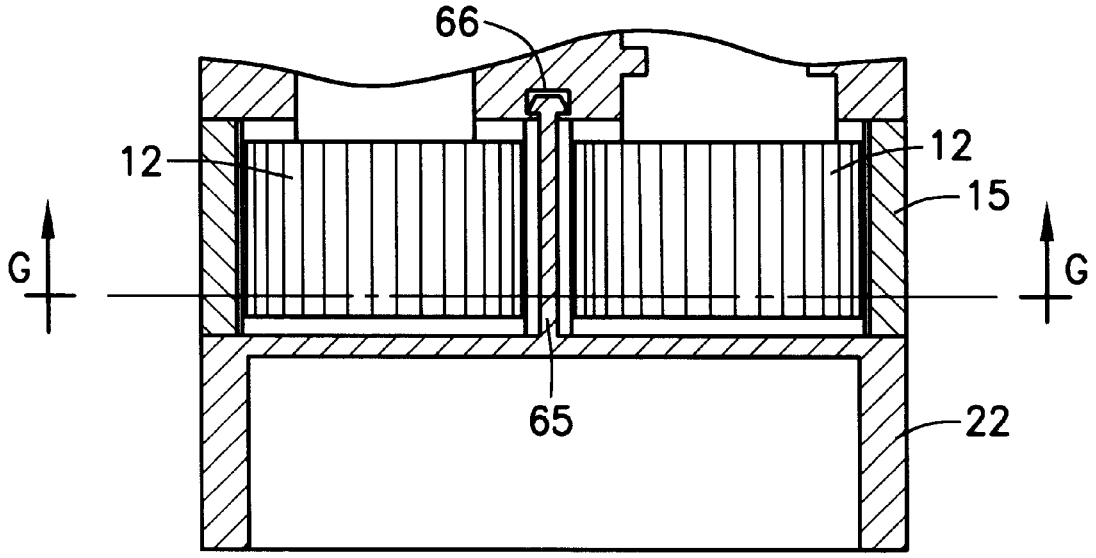
FIG. 14 is a partial cross-sectional view showing the screw members and master gear according to the embodiment of FIG. 13.

In still a further embodiment, as seen in FIGS. 13 and 14, the master gear 15 can be a flexible belt which wraps around and contacts each screw member gear 12. With this embodiment, it will be preferred that the base 22 be secured to the bottom of the housing in a non-rotatable fashion, so as to merely retain the flexible belt in the proper location with respect to the screw member gears 12. This can be accomplished, for example, by providing the base 22 with an upwardly projecting member 65 which engages a complementary shaped recess 66 within the bottom end of the housing. With this embodiment, it is preferred that the shape of the projecting member 65 and the recess 66 be such that the base will not be able to rotate with respect to the housing. Suitable shapes include, for example, square, rectangular, or the like.

Figure 6:
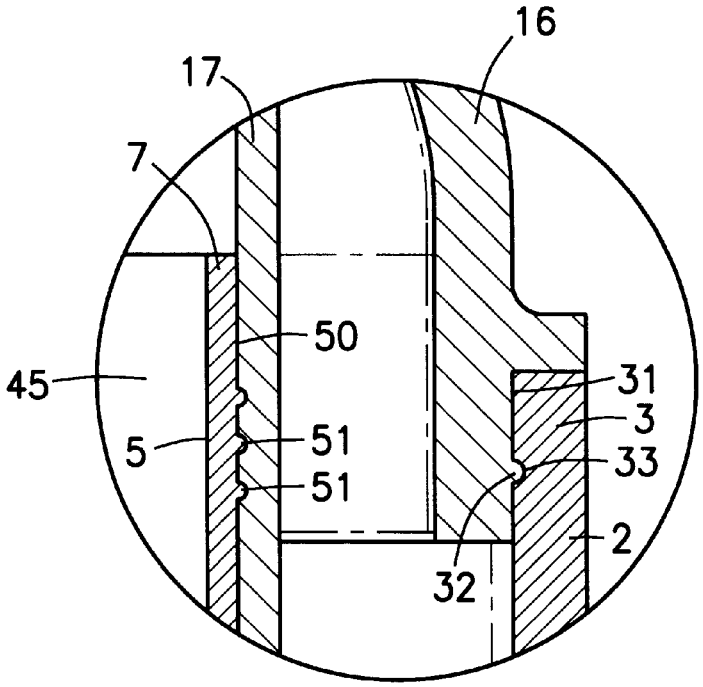
FIG. 6 is an exploded view of Section C of FIG. 2.
Figure 7:
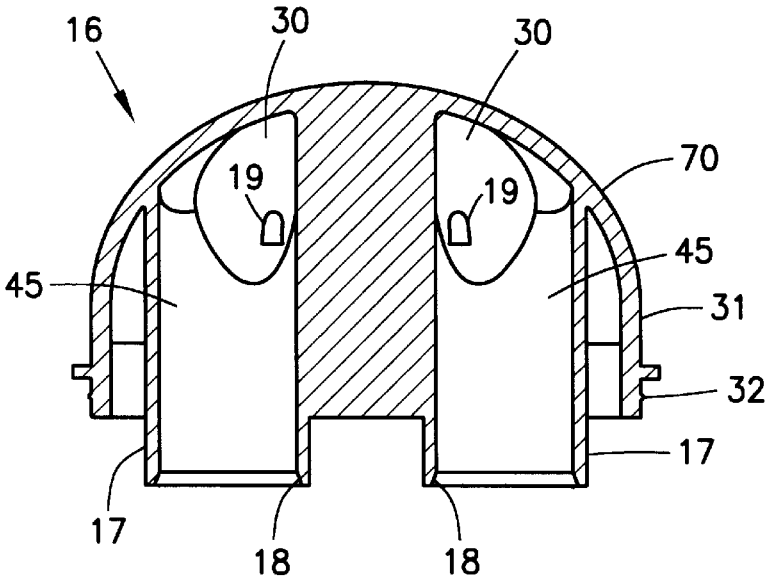
FIG. 7 is a cross-sectional view of the end cap of the present invention along line D—D of FIG. 10.
Figure 8:
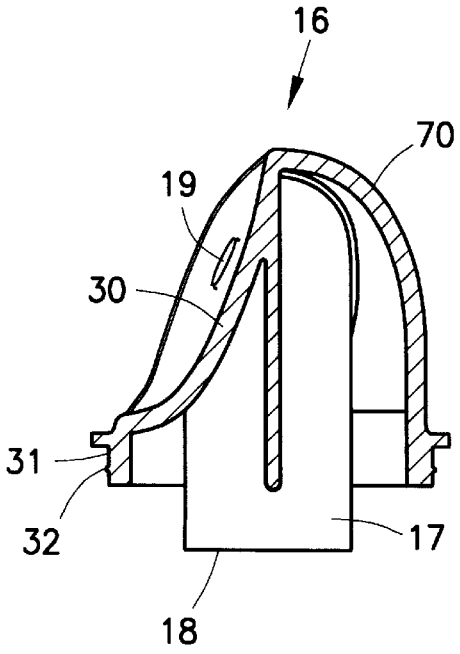
FIG. 8 is a cross-sectional view of the end cap of the present invention along line E—E of FIG. 9.

An end cap, generally referred to as 16, is provided at the top end 3 of the housing. In a preferred embodiment, the end cap 16 is a separate piece which is fitted over the top end 3 of the housing 2. As seen in greater detail in FIG. 7–10, the end cap 16 has an outer shell 70 and a plurality of longitudinally extending second walls 17. The second walls 17 extend through the end cap from a first open end 18 to a second open end 19, wherein the second open ends 19 intersect with the outer shell 70 of the end cap 16. The second walls 17 are positioned within the end cap so that, when the end cap is placed on the top end 3 of the housing 2, as seen in FIG. 1, each first end 18 of the second wall 17 aligns with each of the first open ends 7 of each product compartment 6 thereby defining a dispensing passageway 45 through which the product can exit each product compartment 6. In a preferred embodiment, as seen in FIGS. 1 and 6, the first open end 18 of the second wall 17 is of a slightly larger diameter and fits over the first open end 7 of the wall 5 to define a dispensing passageway 45. It will be evident to one of ordinary skill in the art that the number of second walls within the end cap will be equal to the number of product compartments within the housing.

Preferably, the bottom 31 of the end cap 16 is provided with a retention ring 32 which fits within a groove 33 at the top end 3 of the housing 2. As seen in greater detail in FIG. 6, the interaction of the retention ring 32 and the groove 33 assist in retaining the end cap 16 on the top end 3 of the housing 2. Alternatively, the retention ring can be placed on the top end of the housing and the groove can be placed on the bottom 31 of the end cap.

Additionally, as seen in FIG. 6, the second wall 17 can be provided with one or more sealing rings 51 which contact and seal against wall 5 when the end cap 16 is placed on the top end 3 of the housing. The addition of the sealing rings 51 assist in forming a leak-proof seal through which a non-viscous product cannot pass. FIG. 6 shows the sealing rings 51 positioned on the second wall 17 of the end cap, thus sealing against the wall of the housing. The sealing rings, however, can also be placed on the wall of the housing and seal against the second wall.

In a preferred embodiment, end cap 16 is provided with a mixing surface 30. The mixing surface 30 is obtained by providing the end cap 16 with a flat or concave face which intersects with the second open end 19 of each second wall 17 and the outer shell 70 of the end cap 16. The mixing surface 30 provides the consumer with an area on the package for mixing together the products within each product compartment before application, thus eliminating the need for the consumer to mix together the multiple components of the product directly on the intended area of application. This novel feature allows application of a fully active product directly to the skin, rather than having to wait for the reaction to occur on the skin.

Figure 15:
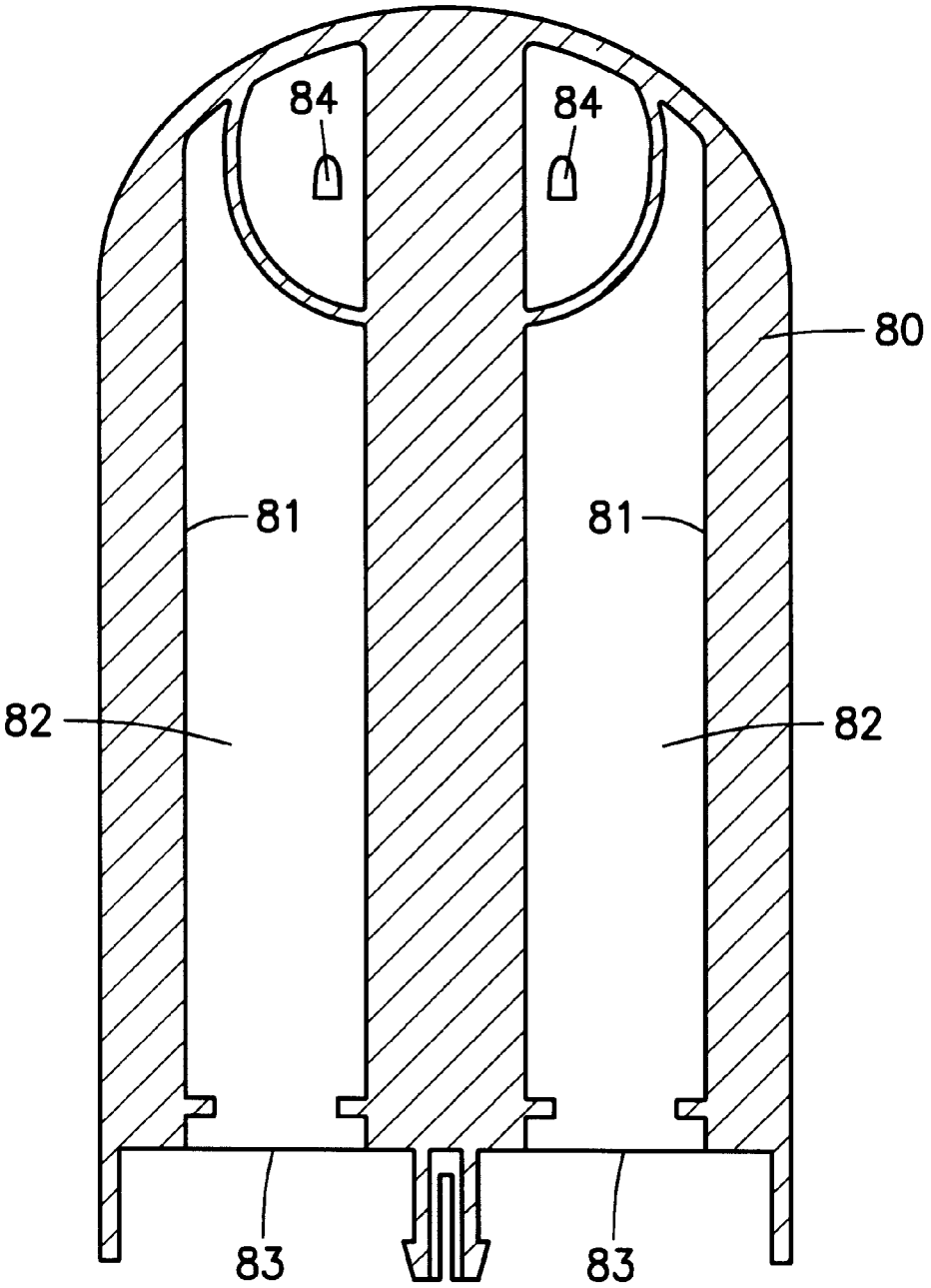
FIG. 15 is a cross sectional view of the dispenser of the present invention having an integrally molded end cap.

Alternatively, as seen in FIG. 15, the end cap can be integrally molded with the housing to form a single body 80. With this embodiment, each of the first walls of the housing and each of the second walls of the end cap will be integrally molded as single wall structures 81, each single wall 81 defining a separate product compartment 82. Each product compartment 82 has a first open end 84, and a second open end 83. The second open end 83 is designed to accommodate a rotatable screw member (not shown) in the same manner as described above. In like manner, the first open end 84 of each product compartment 82 defines a dispensing passageway for the product within each compartment.

Whether the end cap is a separate piece or integrally molded with the housing, filling each product compartment and the subsequent assembly of the entire package is a relatively easy task.

If the end cap is a separate piece, the housing 2 is first assembled with the screw members 9 and master gear 15 rotatably disposed in the locations described above. Then, each product compartment 6 is filled with its intended product component. The end cap 16 is then fitted onto the top end 3 of the housing 2, thus encasing each product component within its respective product compartment 6 and readying the package for dispensing. Preferably, the piston 13 on each screw member 9 is initially positioned substantially at the second open end 8 of the product compartment 6. Thus, when the screw member 9 is rotated, the piston 13 will travel from the second open end 8 of the product compartment 6 towards the first open end 7 of the product compartment 6, thereby causing each product component to be expelled through the dispensing passageway 45 defined by the second walls 17 of the end cap 16.

If the end cap is integrally molded with the housing to form a single body, then the body is inverted and each product compartment is filled with its intended product component. Next, the screw members are rotatably disposed in the locations described above. Then, the master gear is placed in its proper location contacting each screw member, and the package is ready for dispensing.

With any of the embodiments described above, it may be necessary to dispense different amounts of each product component with the single rotation of the master gear. For a situation such as this, the present invention can be easily altered to accommodate almost any desired dispensing ratios. For example, if the end product requires a 2:1 ratio of two separate component products, then all that is required is the modification of the two product compartments to make one compartment double the volume of the other, and modifying the pistons to fit within each product compartment. The pitch of the thread on the screw member, the pitch of the thread on the piston, and the relationship between the master gear and each screw member gear should remain unchanged. This simple change allows each piston to move at the same rate within each product compartment, thus enabling each piston to reach the proximal end of their associated screw members at substantially the same time, and in the process dispense substantially the entire contents of each product compartment while providing a 2:1 ratio between each dispensed product component.

Additionally, it may be desired to provide the present dispenser with a dosage indicator which assists the consumer in determining when the proper or recommended amount of product has been dispensed. For example, as seen in FIG. 12, the bottom end 4 of the housing 2 can be provided with one or more indentations 90, and the master gear 15 can be provided with one or more detents 91 which fit within the indentations 90. When the consumer rotates the master gear to dispense the product, the detent 91 will swivel out of the indentation 90 and into the next successive indentation, thus indicating to the consumer that the recommended dosage has been achieved.

Figure 9:
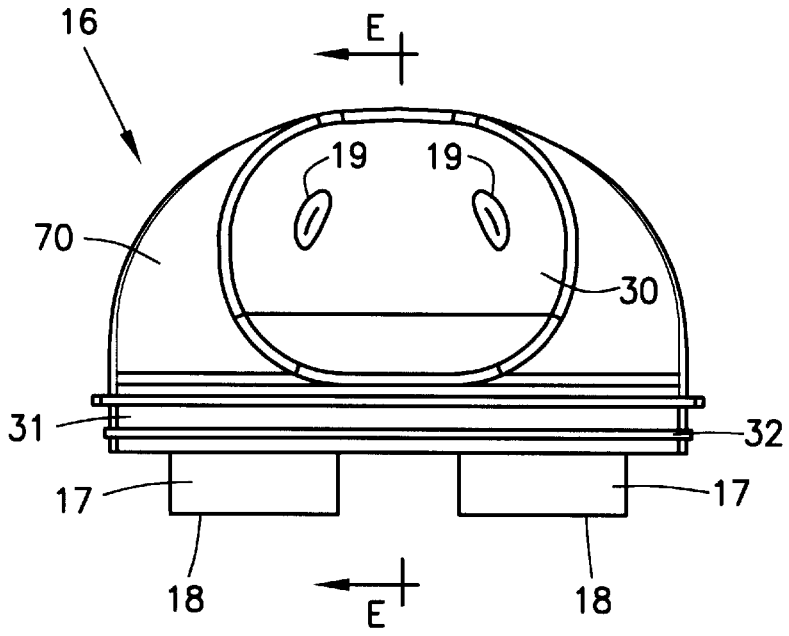
FIG. 9 is a front plan view of the end cap of the present invention.
Figure 10:
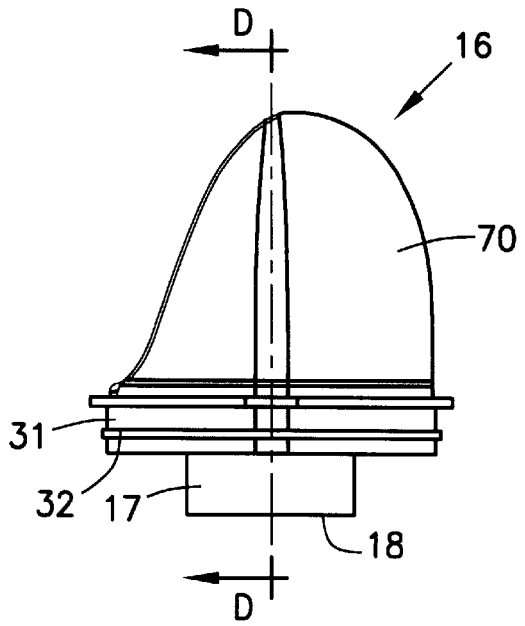
FIG. 10 is a side plan view of the end cap of the present invention.

Further, the second open ends 19 of the end cap 16 can be provided with a self-closing member 92, as seen in FIG. 9. This self-closing member 92 can be a bi-injected flexible membrane which is molded simultaneously with the end cap, or a one-way valve which is a separate part securely held within the second open end of the end cap by an adhesive, a snap-fitment, a friction fit, or the like, such means of securing a part being well known in the art. With either structure, the self-closing member operates by opening as the product is dispensed from the second open end, and then sealing after the desired amount of product has been dispensed.

For ease of fabrication of the present invention it is preferred that all component parts be formed from plastic materials. The particular material chosen for each part will depend on the compatibility characteristics of the product to be contained within the package, as well as the molding characteristics of the material, all of which are within the knowledge of one skilled in the art. Suitable materials include, but are not limited to, polypropylene, polyethylene, polystyrene, polyvinyl chloride, polyethylene terephthalate, acetal, and the like.

The present invention overcomes the shortcomings of the more complicated multiple product-dispensing packages and allows for the simultaneous dispensing of multiple products with the rotation of a single gear, the controlled dispensing of those products to provide a consistent dose with each rotation of the master gear, and the possibility of dispensing different amounts of each product with the same single rotation of the master gear.

What is claimed is:

1. A mechanical twist-dispenser which comprises:

a housing, said housing having a top end and a bottom end;

a plurality of first walls extending longitudinally from the bottom end to the top end of the housing, each first wall defining a separate product compartment, and each product compartment having a first open end and a second open end;

a rotatable screw member axially disposed within each product compartment, each screw member having a proximal end and a distal end;

a gear attached to the distal end of each screw member, said gear rotatably disposed at the second open end of each product compartment;

a piston axially slidably disposed within each product compartment, said piston having a central threaded aperture which cooperates with the screw member to move the piston axially within its product compartment with the relative rotation of the associated screw member;

a master gear rotatably mounted to the bottom of the housing, said master gear contacting each screw member gear.

2. The dispenser of claim 1 wherein the master gear is positioned between and contacts each screw member gear.

3. The dispenser of claim 2 wherein the master gear is provided with a longitudinal bore, and the bottom end of the housing is provided with a boss, said longitudinal bore rotatably mounted about said boss.

4. The dispenser of claim 1 wherein the master gear wraps round and contacts each screw member gear.

5. The dispenser of claim 4 wherein the master gear is a flexible belt which wraps around and contacts each screw member gear.

6. The dispenser of claim 1 wherein the dispenser is provided with a dosage indicator, said dosage indicator comprising one or more successive indentations on the bottom of the housing and one or more detents on the master gear which fit within the indentations, said one or more detent swiveling out of the indentation and into the next successive indentation upon rotation of the master gear.

7. The dispenser of claim 1 wherein an end cap is provided at the top end of the housing, said end cap comprising an outer shell and a plurality of longitudinally extending second walls, said second walls extending through the end cap from a first open end to a second open end, said second open end intersecting with the outer shell, said second walls positioned within the end cap so that each first open end of the second wall aligns with each first open end of each product compartment thereby defining a dispensing passageway.

8. The dispenser of claim 7 wherein the end cap is a separate piece which is placed on the top end of the housing.

9. The dispenser of claim 8 wherein the first open end of the second wall is of a slightly larger diameter and fits over the first open end of the first wall of the housing.

10. The dispenser of claim 8 wherein the end cap is provided with a mixing surface.

11. The dispenser of claim 10 wherein the mixing surface is a flat or concave face which intersects with the second open end of each second wall and the outer shell.

12. The dispenser of claim 7 wherein the end cap is integrally molded with the housing to form a single body.

13. The dispenser of claim 12 wherein the end cap is provided with a mixing surface.

14. The dispenser of claim 13 wherein the mixing surface is a flat or concave face which intersects with the second open end of each second wall and the outer shell.

15. The dispenser of claim 7 wherein the second open ends of the end cap have a self-closing member.

16. The dispenser of claim 15 wherein the self-closing member is a bi-injected flexible membrane which is molded simultaneously with the end cap, or a one-way valve which is a separate part securely held within the second open end of the end cap.

17. A mechanical twist-dispenser which comprises:

a housing, said housing having a top end and a bottom end;

a plurality of first walls extending longitudinally from the bottom end to the top end of the housing, each first wall defining a separate product compartment, and each product compartment having a first open end and a second open end;

a rotatable screw member axially disposed within each product compartment, each screw member having a proximal end and a distal end;

a gear attached to the distal end of each screw member, said gear rotatably disposed at the second open end of each product compartment;

a piston axially slidably disposed within each product compartment, said piston having a central threaded aperture which cooperates with the screw member to move the piston axially within its product compartment with the relative rotation of the associated screw member;

a master gear rotatably mounted to the bottom of the housing, said master gear contacting each screw member gear; and an end cap placed on the top end of the housing, said end cap comprising an outer shell and a plurality of longitudinally extending second walls, said second walls extending through the end cap from a first open end to a second open end, said second open end intersecting with the outer shell, said second walls positioned within the end cap so that each first open end of the second wall aligns with each first open end of each product compartment thereby defining a dispensing passageway.

18. The dispenser of claim 17 wherein the master gear is positioned between and contacts each screw member gear.

19. The dispenser of claim 18 wherein the master gear is provided with a longitudinal bore, and the bottom end of the housing is provided with a boss, said longitudinal bore rotatably mounted about said boss.

20. The dispenser of claim 17 wherein the master gear wraps around and contacts each screw member gear.

21. The dispenser of claim 17 wherein the master gear is a flexible belt which wraps around and contacts each screw member gear.

22. The dispenser of claim 17 wherein the dispenser is provided with a dosage indicator, said dosage indicator comprising one or more successive indentations on the bottom of the housing and one or more detents on the master gear which fit within the indentations, said one or more detent swiveling out of the indentation and into the next successive indentation upon rotation of the master gear.

23. The dispenser of claim 17 wherein the first open end of the second wall is of a slightly larger diameter and fits over the first open end of the first wall of the housing.

24. The dispenser of claim 17 wherein the end cap is provided with a mixing surface.

25. The dispenser of claim 24 wherein the mixing surface is a flat or concave face which intersects with the second open end of each second wall and the outer shell.

26. The dispenser of claim 17 wherein the second open ends of the end cap have a self-closing member.

27. The dispenser of claim 26 wherein the self-closing member is a bi-injected flexible membrane which is molded simultaneously with the end cap, or a one-way valve which is a separate part securely held within the second open end of the end cap.

28. A mechanical twist-dispenser which comprises:

a body, said body having a top end and a bottom end, said top end having an integrally molded end cap, said end cap having an outer shell;

a plurality of walls extending longitudinally from the bottom end to the top end of the body, each wall defining a separate product compartment, and each product compartment having a first open end and a second open end;

a rotatable screw member axially disposed within each product compartment, each screw member having a proximal end and a distal end;

a gear attached to the distal end of each screw member, said gear rotatably disposed at the second open end of each product compartment;

a piston axially slidably disposed within each product compartment, said piston having a central threaded aperture which cooperates with the screw member to move the piston axially within its product compartment with the relative rotation of the associated screw member;

a master gear rotatably mounted to the bottom of the housing, said master gear contacting each screw member gear.

29. The dispenser of claim 28 wherein the master gear is positioned between and contacts each screw member gear.

30. The dispenser of claim 29 wherein the master gear is provided with a longitudinal bore, and the bottom end of the housing is provided with a boss, said longitudinal bore rotatably mounted about said boss.

31. The dispenser of claim 28 wherein the master gear wraps around and contacts each screw member gear.

32. The dispenser of claim 31 wherein the master gear is a flexible belt which wraps around and contacts each screw member gear.

33. The dispenser of claim 28 wherein the dispenser is provided with a dosage indicator, said dosage indicator comprising one or more successive indentations on the bottom of the body and one or more detents on the master gear which fit within the indentations, said one or more detent swiveling out of the indentation and into the next successive indentation upon rotation of the master gear.

34. The dispenser of claim 28 wherein the end cap is provided with a mixing surface.

35. The dispenser of claim 34 wherein the mixing surface is a flat or concave face which intersects with the second open end of each second wall and the outer shell.

36. The dispenser of claim 28 wherein the first open ends of the end cap have a self-closing member.

37. The dispenser of claim 36 wherein the self-closing member is a bi-injected flexible membrane which is molded simultaneously with the end cap, or a one-way valve which is a separate part securely held within the second open end of the end cap.

* * * * *